US005203999A

United States Patent [19]

Hugues

[11] Patent Number: 5,203,999

[45] Date of Patent: Apr. 20, 1993

[54] CENTRIFUGAL OIL FILTER WITH PARTICLE COLLECTOR

[75] Inventor: Michel G. Hugues, Bois le Roi, France

[73] Assignee: Societe Nationale d'Etude et de Construction de Moteurs d'Aviation "S.N.E.C.M.A.", Paris, France

[21] Appl. No.: 825,576

[22] Filed: Jan. 24, 1992

[30] Foreign Application Priority Data

Jan. 30, 1991 [FR] France ..... 91 01021

[51] Int. Cl.[5] ..... B04B 5/04

[52] U.S. Cl. ..... 210/512.3; 210/512.1; 494/43; 494/50; 494/60; 494/65

[58] Field of Search ..... 210/94, 168, 360.1, 210/380.1, 512.1, 512.3, DIG. 1; 494/43, 50, 60, 65, 901

[56] References Cited

U.S. PATENT DOCUMENTS

| | | | |
|---|---|---|---|
| 4,312,751 | 1/1982 | Casamitjana | 210/94 |
| 4,533,468 | 8/1985 | Ensor et al. . | |
| 4,663,035 | 5/1987 | Rosander | 210/512.3 |

FOREIGN PATENT DOCUMENTS

| | | |
|---|---|---|
| 337447 | 6/1920 | Fed. Rep. of Germany . |
| 2850556 | 6/1980 | Fed. Rep. of Germany . |
| 3521929 | 1/1986 | Fed. Rep. of Germany . |
| 924144 | 7/1947 | France . |
| WO8100005 | 1/1981 | PCT Int'l Appl. . |
| 2137537 | 10/1984 | United Kingdom . |

OTHER PUBLICATIONS

Patent Abstracts of Japan, vol. 6, No. 35 (C-93) [913], Mar. 3, 1982, & JP-A-56-152753, Nov. 26, 1981, S. Sumino, "Sludge Dehydrating and Separating Device for Purification Tank".

Soviet Inventions Illustrated, section P, week 8724, Jun. 24, 1987, Derwent Publications Ltd., London, GB, pp. 41, No. 87-168532/24 & su-a-1264985 (mosc cons road mach), Oct. 23, 1986, "Centrifugal Oil Cleaner—Has Cyindrical Preforated Cowling With Shaped . . . ".

*Primary Examiner*—Robert A. Dawson
*Assistant Examiner*—David Reifsnyder
*Attorney, Agent, or Firm*—Oblon, Spivak, McClelland, Maier & Neustadt

[57] ABSTRACT

A centrifugal oil filter comprises a bowl which is rotatable about a vertical axis within a fixed casing and which is open at its upper and lower ends, the inner wall of the bowl being provided with grooves which trap particles in the polluted oil fed into the bowl as the bowl is rotated and the oil flows upwards along the wall under centrifugal action and which allow the particles to fall therefrom under gravity to a particle collector positioned below the open lower end of the bowl when the bowl stops rotating. The inner wall of the bowl is also formed with an annular recess above the particle trapping grooves. This recess fills with oil when the bowl is rotated, and this oil flows out and downwards along the wall under gravity when the bowl stops, thereby cleaning the filter wall.

6 Claims, 1 Drawing Sheet

FIG. 1
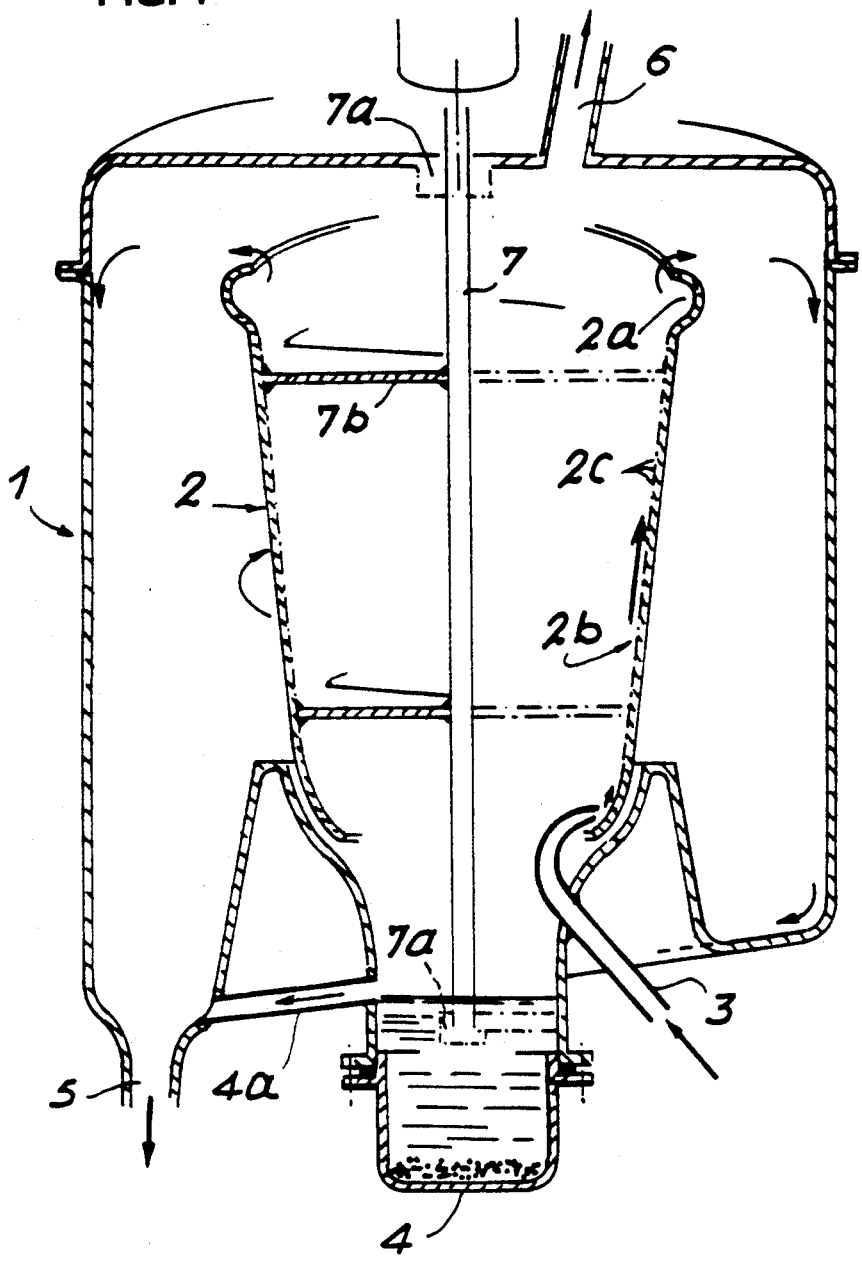
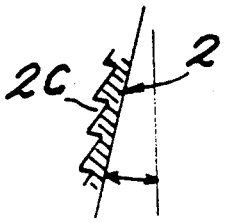
FIG. 2

CENTRIFUGAL OIL FILTER WITH PARTICLE COLLECTOR

BACKGROUND OF THE INVENTION

1. Field of the Invention

The present invention relates to a centrifugal oil filter with particle collecting means permitting filtration of polluted oil by separating the air, the oil and the particles. The filter may be used in the mechanical field and, in particular, for reprocessing the oil used in bearings and gears, thereby improving the working life of these components.

2. Summary of the Prior Art

Generally, the known centrifugal oil filters which permit the separation of air, oil and particles do not provide for the collection of the particles. In most cases, the separated particles build up on the inner wall of the device, which necessitates manual intervention to demount and clean the filter. An example of such a device is disclosed in International Specification No. WO 81/00005 in the name of AVCO CORPORATION (USA).

SUMMARY OF THE INVENTION

The object of the present invention is to overcome this problem by providing the filter with internal self-cleaning means and means for collecting the particles separated from the oil and the air.

Throughout this specification, the expression "polluted oil" refers to the mixture of air, oil and particles which is to be separated by the filter.

The invention is based on the idea of trapping the particles on an internal wall of the device during the filtering operation and then cleaning this wall using an oil reservoir which is also used during the filtering operation.

More precisely, according to the invention there is provided a centrifugal oil filter comprising a rotatable bowl, means mounting said bowl for rotation about a substantially vertical axis, oil inlet means opening into the lower portion of said bowl, means permitting the overflow of oil from the upper portion of said bowl when said bowl is rotating, and a fixed particle collector situated beneath said bowl, said bowl being open at the bottom thereof and having an inner wall provided with particle trapping means and an annular recess forming an oil reservoir situated above said particle trapping means.

Preferably, the particle trapping means comprise grooves oriented in such a manner that particles trapped in said grooves under centrifugal action when said bowl is rotating fall due to gravity into said particle collector when said bowl stops.

The annular recess situated above said particle trapping means is arranged so as to fill with oil when said bowl is rotating, said oil flowing from said recess downwards along said inner wall under gravity when said bowl stops rotating, thereby ensuring the fall of particles left on said wall and the cleaning of said bowl.

The oil inlet means preferably comprises an oil feed pipe opening towards said inner wall of said bowl at a position below said particle trapping means, and preferably the bowl has an upwardly flaring truncated conical shape to facilitate oil flow.

The filter preferably includes a fixed casing forming an enclosure all around the rotatable bowl for collecting the oil which overflows from the open upper end of the bowl when it is rotating. The casing may have a duct at the top for connection to degassing means, and a part forming the particle collector beneath the open bottom of the bowl, the particle collector preferably being removable to enable easy recovery of the particles.

The lower portion of the casing may also include an oil outlet duct, and an oil overflow duct for the particle collector, the overflow duct running from position above the top part of the collector a position adjacent the oil outlet at the bottom of the casing.

If desired, the particle collector may be made of a transparent material so that the particles may be viewed during operation of the filter, or when it is at rest, without opening the filter.

Such a device in accordance with the invention not only simplifies the cleaning of the filter but also enables the particles to be sampled for analysis in a particularly easy manner.

Other features and advantages of the invention will become apparent from the following description of a preferred embodiment, given by way of example only, with reference to the accompanying drawings.

BRIEF DESCRIPTION OF THE DRAWINGS

FIG. 1 is a diagrammatic longitudinal cross-sectional view of one embodiment of a centrifugal oil filter in accordance with the invention.

FIG. 2 is a diagrammatic sectional view, on a larger scale, of part of the bowl wall in the filter.

DESCRIPTION OF THE PREFERRED EMBODIMENT

The centrifugal oil filter shown in FIG. 1 has a fixed casing 1 provided with a pipe 6 which communicates the inside of the casing 1 with a degassing device (not shown) placed on the upper surface of the casing.

Inside the casing 1, a rotatable bowl 2 is mounted so as to rotate around a substantially vertical axis defined by a spindle 7 which is driven by a motor or other power source (not shown) and which is mounted in the casing 1 by bearings 7*a*. The rotatable bowl 2 is fixed to the spindle 7 by means of cross-pieces 7*b*, and is open at its upper and lower ends. Moreover, the bowl is of an inverted truncated conical shape, which facilitates the flow of oil, both upwardly along the inner wall 2*b* when the bowl rotates, and downwardly under the effect of gravity when the bowl has stopped.

The inner wall 2*b* of the bowl 2 has grooves 2*c* designed to trap centrifuged particles when the bowl 2 is rotating. These grooves 2*c* are oriented in the manner shown in FIG. 2, so that the particles trapped during centrifuging fall towards the lower part of the bowl under the force of gravity when rotation ceases.

The wall 2*b* is also formed with an annular recess 2*a* in the upper part of the bowl 2 above the grooves 2*b*. This recess 2*a* permits the formation of an oil reservoir when the bowl is rotating, and the oil from this reservoir flows back down along the wall 2*b* when the bowl 2 ceases to rotate, thereby effecting, if needed, cleaning of the wall.

In operation, polluted oil is supplied to the filter by an oil supply pipe 3 which opens into the lower part of the bowl 2 towards the wall 2*b*. Under the action of the centrifugal force created by rotation of the bowl 2, the polluted oil is separated into oil, air and particles. The air is evacuated by the degassing device connected to the casing 1 by means of the pipe 6. The oil film travelling to the top of the bowl as it rotates overflows from the bowl 2 into the casing 1, following the path shown by the arrows, and then flows out of the casing 1 via an outlet duct 5 at the bottom. The particles are trapped in the grooves 2*c* of the wall 2*b* and, when the bowl stops rotating, fall downwards under the force of gravity into particle collector 4 fixed to the casing 1 beneath the open lower end of the bowl 2. Particles which remain on the wall are removed by the cleaning flow of oil from the annular recess 2*a*. This oil flows down into the collector 4, and excess oil escapes through an overflow duct 4*a* which runs, as shown, from just above the collector 4 to the lower part of the casing adjacent the outlet duct 5.

In preferred embodiments of the invention the particle collector 4 is removable, thus allowing easy recovery of the collected particles 2. In addition, it is made of a transparent material, so that the particles may be viewed, both during operation of the filter and when the bowl 2 is at rest, without dismantling the filter.

In addition to the advantages already described, the filter in accordance with the invention can lead to an increase in the life of mechanical parts, such as bearings and gears, lubricated by an oil circuit in which the filter is fitted.

What is claimed as new and desired to be secured by Letters Patent of the United States is:

1. A centrifugal oil filter, comprising:

a rotatable bowl, means for mounting said bowl for rotation about a substantially vertical axis, oil inlet means opening into the lower portion of said bowl, means for permitting an overflow of oil from an upper portion of said bowl when said bowl is rotating, and a fixed particle collector situated beneath said bowl, said bowl having an open bottom portion, an inner wall, particle trapping means located on said inner wall, and an annular recess forming an oil reservoir situated above said particle trapping means wherein said particle trapping means comprises a plurality of grooves formed on said inner wall such that particles are trapped in said grooves due to centrifugal force when said bowl is rotating and fall due to a force of gravity into said particle collector when said blow stops rotating.

2. A centrifugal oil filter according to claim 1, wherein said annular recess situated above said particle trapping means is arranged so as to fill with oil when said bowl is rotating, said oil flowing from said recess downwards along said inner wall under a force of gravity when said bowl stops rotating, thereby ensuring that the particles left on said wall fall into said particle collector so as to clean said bowl of particles trapped in said grooves.

3. A centrifugal oil filter according to claim 1, wherein said oil inlet means comprises an oil feed pipe opening towards said inner wall of said bowl at a position below said particle trapping means, and wherein said bowl has an upwardly flared truncated conical shape to facilitate the flow of oil.

4. A centrifugal oil filter according to claim 1, further comprising a fixed casing for surrounding said rotatable bowl for collecting oil which overflows from said upper portion of said bowl when said bowl is rotating;

a pipe connected to said casing at an upper surface of said casing for connection to degassing means; and means for removably connecting said particle collector to said open bottom potion of said bowl.

5. A centrifugal oil filter according to claim 4, which comprises an oil outlet duct situated in the lower portion of said casing.

6. A centrifugal oil filter according to claim 5, which comprises an overflow duct located in the lower portion of the casing, said overflow duct extending from a position above said particle collector to a position adjacent said oil outlet duct.

* * * * *